United States Patent [19]

Pokhis et al.

[11] 4,374,584

[45] Feb. 22, 1983

[54] HANDRAIL

[76] Inventors: Naum Pokhis; Yakov Pokhis, both of 1850 No. Whitley Ave. # 317, Hollywood, Calif. 90028

[21] Appl. No.: 962,986

[22] Filed: Dec. 22, 1978

[51] Int. Cl.[3] ..... E04H 17/00

[52] U.S. Cl. ..... 256/1; 198/335; 52/183

[58] Field of Search ..... 198/335, 750, 337, 331, 198/336; 256/59, 1; 52/183, 184, 29; 104/162, 165

[56] References Cited

U.S. PATENT DOCUMENTS

| | | | |
|---|---|---|---|
| 2,576,556 | 11/1951 | Babson | 52/183 |
| 3,352,436 | 11/1967 | Vesconte et al. | 104/162 X |
| 4,132,391 | 1/1979 | Takenaga | 256/59 |

FOREIGN PATENT DOCUMENTS

| | | | |
|---|---|---|---|
| 1114034 | 12/1955 | France | 198/335 |
| 1508069 | 4/1978 | United Kingdom | 256/59 |

*Primary Examiner*—Andrew V. Kundrat
*Attorney, Agent, or Firm*—Ilya Zborovsky

[57] ABSTRACT

A handrail has an immovable base element extending in one direction, a support element arranged to be grasped by a user and reciprocable relative to the base element, and a drive for reciprocating the support element relative to the base element. The base element may be formed by a usual stationary handrail, may be connected to the latter, or may be formed as a plate. A guiding element guides the support element during its reciprocation. The drive includes an electric motor which is reversible, a spindle member provided with a thread and rotatable by the motor, and a nut member translatorily movable by the rotation of the spindle member and connected with the support element so as to move the latter. Switches are provided for reversing the direction of rotation of the electric motor and thereby the direction of movement of the nut member and the support element.

12 Claims, 6 Drawing Figures

HANDRAIL

BACKGROUND OF THE INVENTION

The present invention relates to a handrail. Great variety of handrails are widely utilized. Generally, handrails are immovable which has the disadvantage that when a user goes upstairs a handrail does not urge the user but the latter has to apply his or her muscle force during grasping the handrail. For this reason it is difficult to go upstairs, and the steps of stairs are constructed so that their vertical dimensions are small.

Movable handrails have also been utilized such as in subways or the like. The movable rails have never been utilized with immovable stairs which means that the movable handrails associated with movable stairs do not perform the functions of active help to a user. The movable handrails move generally in one direction but do not continuously reciprocate. Drive means of such handrails are very complicated. Finally, they cannot be utilized in a region wherein great space is unavailable or the trajectory must be curved, for example in buildings, with spiral stairs and the like.

SUMMARY OF THE INVENTION

Accordingly, it is an object of the present invention to provide a handrail which avoids the disadvantages of the prior art.

More particularly, it is an object of the present invention to provide a handrail which can help a user, has a simple construction, and does not require a great space.

In keeping with these objects and with others which will become apparent hereinafter, one feature of the present invention resides, briefly stated, in a handrail which has an immovable base element, a movable support element which can be grasped by a user, and means for reciprocating said movable support element relative to said base element.

When the user grasps the reciprocable support member by his or her hand, the support element helps him or her to go upwardly. Means for reciprocating which is utilized in the inventive handrail is of a very simple construction. Since the support element does not move in one direction but recprocates between two steps of stairs, the handrail can be utilized in the regions when only a small space is available including curved regions. In addition, the inventive handrail can be mounted on presently installed immovable handrails. The inventive handrail is more economical than the subway handrails since it can be actuated for reciprocation only immediately before the intended use.

The novel features which are considered as characteristic for the present invention are set forth in the appended claims. The invention itself, however, will be best understood from the specification describing the invention together with the accompanying drawings.

DESCRIPTION OF A PREFERRED EMBODIMENT

Figure 1:
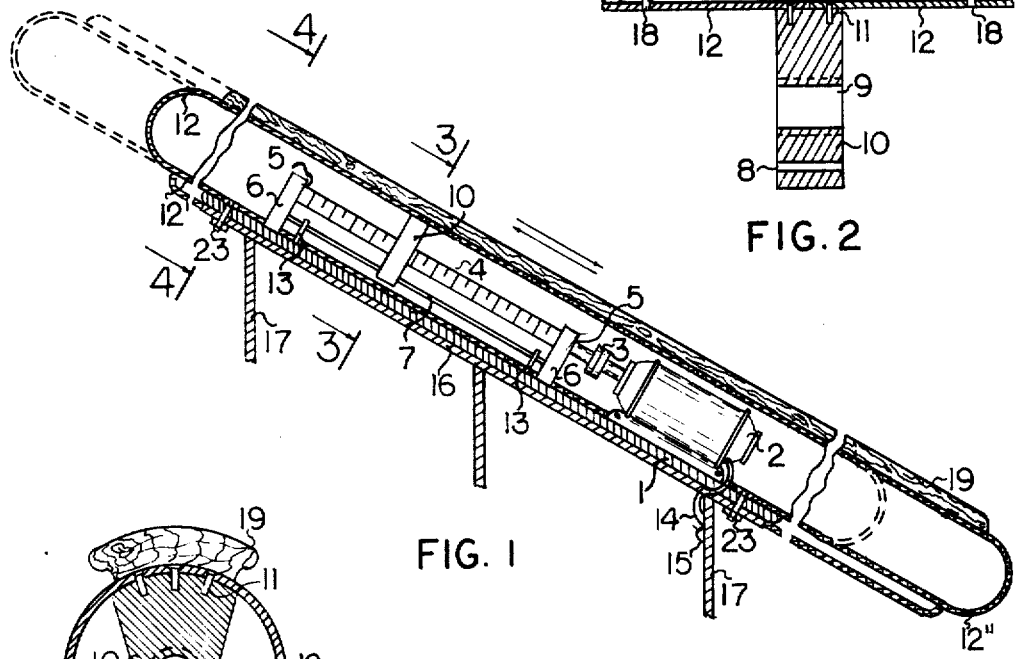
FIG. 1 is a view showing a section of a handrail in accordance with the present invention.
Figure 2:
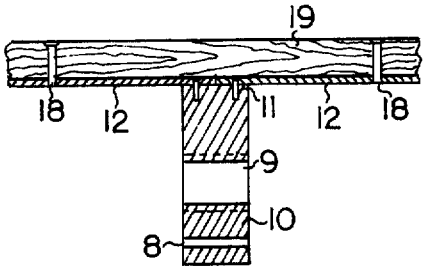
FIG. 2 is a view showing two portions of a support element of the handrail, which are connected with one another.

A handrail in accordance with the present invention has a base element 1 which is formed as an elongated plate, and a support element 12 which is formed as an elongated sleeve having a gap 21 extending in the direction of elongation. A reversible motor 2 is provided, being immovably mounted on the base element 1 and connected with a rotatable spindle member 4 through a clutch 3.

The spindle member 4 is threaded and extends through a threaded nut member 10. The nut member 10 is sector-like and has an upper opening 9 and the lower opening 8. The openings have axes which are located on a vertical center line of the sector-like nut member 10. A wall of the nut member 10, which bounds the opening 9 is threaded. The threads of the spindle member 4 and the nut member 10 mesh with one another.

The support element 12 is composed of two sleeves 12' and 12''. The juxtaposed end sections of the sleeves 12' and 12'' are connected to an upper surface of the nut member 10, for instance by screws 11. Thereby, they are also connected with one another.

Two legs 6 are immovably mounted on the base element 1 in spaced relationship as considered in the direction of elongation. Each leg 6 has an opening in which a bearing 5 is received. The spindle member 4 extends through and rotates in the bearing 5 of the legs 6.

A guiding member 7 is further provided, It extends through the lower opening 8 of the nut member 10 with play and is immovably connected to the legs 6. Two end switches 13 are mounted on the guiding member 7 and spaced from one another in the direction of elongation of the base element 1 and the guiding member 7. The switches 13 are operatively connected with the electric motor 2 so as to reverse its direction of rotation when a respective one of the switches 13 are actuated by a nut member 10. The switches are mounted on the guiding member 7 movably in the direction of elongation so that the distance therebetween can be adjusted whereby the time periods between the reverses of direction of rotation can be changed.

The base element 1 is mounted immovably to an immovable object. It may be formed as an upper part of an immovable handrail in a building. On the other hand, it can be mounted on an upper part 16 of the immovable handrail, as shown in FIG. 1. It also may be connected to a stationary wall. Mounting elements such as screws 23 may be provided for immovably mounting the base element. A part of the immovable handrail or other immovable objects extend outwardly beyond the sleeve-shaped support element 12 through the gap 21 which is formed in the support element 12 particularly for this purpose.

Figure 3:
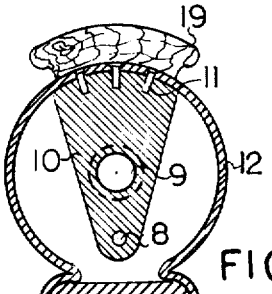
FIG. 3 is a transverse cross section of the handrail in the central region thereof.

The handrail in accordance with the present invention operates in the following manner:

The electric motor 2 is energized and rotates the spindle member 4. The upper surface of the nut member 10 abuts against the inner surface of the support element and is fixedly connected thereto so that the nut member 10 cannot rotate with the spindle member 4 but, instead, moves in the direction of elongation of the base element 1. As can be seen from FIG. 3, an upper surface of a lower portion of the support element 12 is in sliding contact with a lower surface of the base element 1. In order to reduce friction, these surfaces may be coated by a material having low-frictional characteristics, or separated by rotatable bodies such as balls. The nut member 10 moves in the direction of elongation of the base element 1 in one direction and pulls the support element 12 therewith in the same direction. During this movememt the nut member 10 is additionally guided by the guiding member 7. When the nut member 10 reaches and contacts one of the switches 13 at the end of its movement in the one direction, the one switch reverses the direction of rotation of the electric motor 2. Thereby, the spindle member 4 starts to rotate in the opposite direction and moves the nut member 10 also in the opposite direction lengthwise of the base element 1. Preferably, the switches are spaced from one another by such a distance, that the support element 12 moves in one direction by a distance corresponding to that between the two adjacent steps of the staircase.

Figure 4:
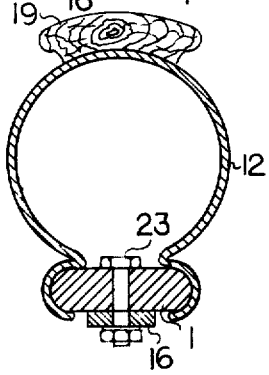
FIG. 4 is a transverse cross section of the handrail in the end region thereof.
Figure 5:
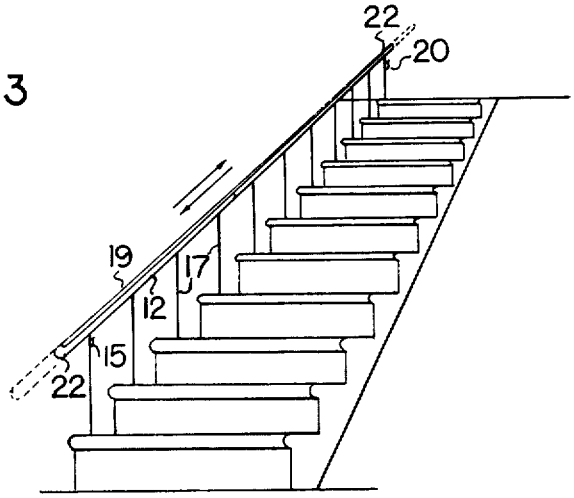
FIG. 5 is a view showing a staircase associated with the inventive handrail.
Figure 6:
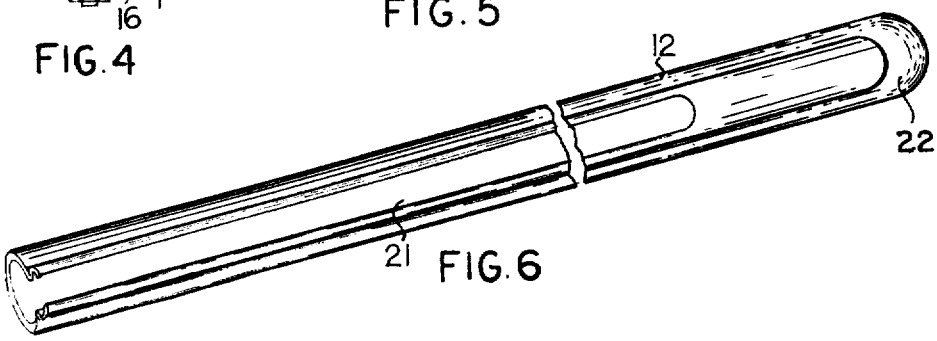
FIG. 6 is a view of a portion of the support element shown from below.

The base element 1 has a length which exceeds the length of the slot of the support element 12 plus two times the distance by which the support element 12 moves in each direction. In such a construction in each location of the support element 12 relative to the base element 1 during the movement of the former, the slot 21 is continuously closed by the base element 1. In other words, the support element 12 has end portions which are not slotted, as shown in FIG. 4.

As can be seen from the drawing, the support element 12 surrounds the motor, the nut member, the spindle member and the guiding member by an upper portion of a loop-shaped cross section. A lower loop-shaped portion of the support element 12 surrounds the base member 1.

The inventive handrail may describe a curved trajectory. For this purpose, the base element 1 formed as a plate, as a part of a stationary handrail or the like may have at least end sections which are curved. In order to provide for movement of the support element 12 over the curved end sections of the base element 1, at least end portions 22 of the support element 12 are elastic. They may be constituted by an elastic synthetic plastic material. When the support element 12 moves over the base element 1 with the curved end sections, the elastic end portions of the support element 12 are bent in accordance with the curvature of the end sections of the base element 1. The rolling bodies such as balls may be provided between the above-mentioned end sections and end portions.

ON-OFF switches 15 and 20 are further provided. They are mounted in the end regions of the handrail and are operative for switching on and off the electric motor 2 and thereby actuating the handrail. The electric motor 2 is connected with an electric source by a conductor 14. A projection such as an elongated wooden bar 19 can be mounted on the support element 12 in order to improve the convenience for a user to grasp the handrail.

It will be understood that each and every element described above may find a useful application in other systems. Various modifications are possible without departing from the spirit of the present invention. The foregoing so fully reveals the gist of the invention that others by applying current knowledge can readily adapt it for various applications without omitting features which from the standpoint of the prior art, fairly constitute essential characteristics of the present invention.

What is claimed as desired to be protected by Letters Patent is set forth in the following claims.

1. A handrail comprising an elongated stationary base element; a support element adapted to be grasped by and support a user, said support element being movable relative to said base member in a direction of elongation thereof; means for moving said support element relative to said base element, said moving means being means for reciprocating said support element relative to said base element and including a motor and transmission means which is driven by said motor and engaged with said support element so as to reciprocate the latter, said motor being reversible, and said transmission means including a screw member rotated by said motor, and a nut member which is connected with said support element and through which said screw extends so that when said motor rotates said screw in two opposite directions said nut member and thereby said support element connected thereto reciprocate relative to said base member; and a guiding member which is immovably connected to said base element and extends through said nut member in the direction of elongation whereby said nut member is guided by said guiding member during the reciprocation.

2. A handrail as defined in claim 1; and further comprising two legs extending in a direction transverse to the direction of elongation and immovably connected to said base element, said screw member movably extending through said legs whereas said guiding member also extends through said legs and is immovably connected thereto.

3. A handrail as defined in claim 2; and further comprising means for immovably mounting said base member to an object, said support element being sleeve-shaped and surrounding said motor and said transmission means, said support element having a lower slot through which said mounting means extends.

4. A handrail as defined in claim 3, wherein said slot has a predetermined length, said support element being reciprocable in two opposite directions by a predetermined distance in each of said direction, said base element having a length exceeding the length of said slot plus two said distances.

5. A handrail as defined in claim 1, and further comprising means for reversing the rotation of said motor, said reversing means including two switches which are spaced from one another in the direction of elongation of said base element and mounted on said guiding member so that when said nut member reaches said switches it controls said motor to respectively reverse the direction of rotation of the latter.

6. A handrail as defined in claim 1, wherein said nut member is sector-shaped and has a center line extending in an upright direction transverse to the direction of elongation, said nut member having a first opening through which said screw member extends, and a second opening through which said guiding member extends, said first opening being located above said second opening and said openings have axes which are located on said center line.

7. A handrail as defined in claim 1, wherein said base element is a stationary handrail.

8. A handrail as defined in claim 1, and further comprising a stationary handrail, said base element being immovably mounted on said stationary handrail.

9. A handrail comprising an elongated stationary base element having two end portions which are spaced from one another in the direction of elongation and are curved; a support element adapted to be grasped by a user and movable relative to said base member in the direction of elongation thereof, said support element having two end sections which are spaced from one another in the direction of elongation and are elastic so that they bend when they move over said curved portions of said base element; and means for moving said support element relative to said base element, said moving means being means for reciprocating said support element relative to said base element and including a motor and transmission means which is driven by said motor and engages with said support element so as to reciprocate the latter.

10. A handrail as defined in claim 9, wherein said motor is reversible, said transmission means including a screw member rotated by said motor, and a nut member which is connected with said support element and through which said screw extends so that when said motor rotates said screw in two opposite directions said nut member and thereby said support element connected thereto reciprocate relative to said base member.

11. A handrail as defined in claim 10, wherein said support element is composed of two sleeve-shaped members having two proximal ends and connected with one another at said ends; and further comprising means for connecting said proximal ends of said sleeve-shaped members with one another and for simultaneously connecting them to said nut member.

12. A hadrail as defined in claim 10, wherein said base element has a lower surface, said support element having a lower portion embracing said base element and having an inner upper surface which is in sliding contact with said lower surface of said base element.

* * * * *